United States Patent [19]

Senoo et al.

[11] 4,050,230

[45] Sept. 27, 1977

[54] ROPE

[75] Inventors: Tadao Senoo, Gifu; Kenji Honda, Gamagori, both of Japan

[73] Assignees: Ube Nitto Kasei Co., Ltd., Tokyo; Toyo Rope Manufacturing Co., Ltd., Gamagori, both of Japan

[21] Appl. No.: 660,406

[22] Filed: Feb. 23, 1976

[30] Foreign Application Priority Data

Feb. 24, 1975 Japan ..... 50-22651
Jan. 12, 1976 Japan ..... 51-1901[U]

[51] Int. Cl.[2] ..... D02G 3/04; D02G 3/36
[52] U.S. Cl. ..... 57/149; 57/140 C
[58] Field of Search ..... 57/149, 153, 162, 164, 57/140 R, 144

[56] References Cited

U.S. PATENT DOCUMENTS

| | | | |
|---|---|---|---|
| 3,371,476 | 3/1968 | Costello et al. | 57/140 G X |
| 3,391,052 | 7/1968 | Marzocchi | 57/140 G X |
| 3,395,529 | 8/1968 | Ray | 57/153 |
| 3,413,186 | 11/1968 | Marzocchi | 57/164 X |
| 3,425,207 | 2/1969 | Campbell | 57/149 X |

*Primary Examiner*—Donald Watkins
*Attorney, Agent, or Firm*—Wenderoth, Lind & Ponack

[57] ABSTRACT

The rope of this invention comprises a plurality of strands each having a twisted reinforcing fiber bundle, thermosetting resin applied to the fiber bundle, and a thermoplastic resin cover enclosing the fiber bundle. Each strand in the rope is kept to substantially a round sectional shape by the twisted fiber bundle.

The method for forming the rope comprises the steps of twisting the reinforcing fibers in such a manner that the tensile strength of the twisted fibers is not reduced to less than 50% of the fibers not twisted, applying an uncured thermosetting resin to the twisted fibers, covering the fibers with a molten thermoplastic resin, cooling the thermoplastic resin to cover the fibers with solidified thermoplastic resin and thereby forming a strand, forming a rope structure from a plurality of the strands, and heating the rope structure to cure the thermosetting resin applied on the fibers.

5 Claims, 7 Drawing Figures

ROPE

BACKGROUND OF THE INVENTION

This invention relates to a rope and a method for forming the same and, more particularly, to a rope and a method thereof in which reinforcing fibers having high tensile strength and low elongation, such as glass fibers or aramid fibers, are used.

For a rope having high tensile strength and low elongation, a wire rope has been widely used in which a number of steel wires are layed, braided or plaited with each other or are so formed around a fiber core such as jute yarns so as to have desired rope structures and diameters in accordance with various usages.

Due to this high tensile strength and low elongation, the wire rope has an advantage over natural fiber ropes made of Manila hemp or sisal hemp and known synthetic fiber ropes made of nylon or polypropylene. Onn the other hand, compared with the fiber ropes, many disadvantages have been experienced in the wire rope owing to its heavy weight, electrical conductivity, and corrosiveness. Accordingly, when a wire rope having the length of hundreds or thousands of meters is used, vast supporting devices, suspension devices or winding devices must be used due to the heavy weight of the wire rope, so that there is a limit in the use of such a wire rope in some instances, such as dredging the bottom of the ocean or such. Furthermore, due to the electrical conductibility of the wire, when the wire rope is to be used as a stay for an antenna or such, insulators must be used to connect the rope with the wires, thereby causing complexity of the structure. The corrosiveness of the wire rope will weaken the tensile strength thereof and further cause trouble in the operation of the winder of the rope or such.

In known fiber ropes, fibers or fiber bundles are twisted and then layed, braided or plaited as referred to hereinafter as "formed into a rope structure" so as to maintain the desired configuration of the fiber rope. However, it is known that such twisting and forming of the fibers into a rope structure remarkably reduces the tensile strength of the fiber itself so tht most of the fiber rope thus formed has a tensile strength of less than 50 percent of that of the fiber bundles gathered without twisting. Accordingly, when fibers such as nylone or polypropylene having relatively high elongation compared with the steel wire are used for the fiber rope, the elongation of the fiber rope will be much increased due to the twisting and forming steps of the rope structure and will become several to tens of times of that of the wire rope. Thus, this fiber roping cannot be used as suspension ropes or supporting ropes for heavy loads. Further, the fiber ropes are generally weak against abrasion and therefor, the fiber ropes will easily be injured or damaged wwhen they movably contact or slide against any rough surface and can be cut by sharp, knife-like edges.

Accordingly, an object of the present invenion is to provide a rope which eliminates the disadvantages of the wire rope and the known fiber ropes set forth above.

Another object of the present invention is to provide a rope light in weight which has high tensile strength and low elongation.

A further object of the present invention is to provide a relatively flexible rope light in weight which may be advantageously used in a dynamic condition with a winder or such.

A further object of the present invention is to provide a relatively flexible rope light in weight which can absorb high external force applied in the radial direction thereto at a place where the rope contacts a wind-up drum or such.

Still another object of the present invention is to provide a method for forming a rope having the above defined characteristics.

BRIEF SUMMARY OF THE INVENTION

A rope according to the present invention comprises a plurality of strands each of which is twisted into a reinforcing fiber bundle with thermosetting resin applied on the fiber bundle, and a thermoplastic resin cover encloses the fiber bundle. Each of the strands is isolated from other fiber bundles in other strands by means of the thermoplastic resin cover, and therefore, when the rope is bent or curved along a wind-up drum for example, the strands will slightly slide from the other strands at the curved portion, which means that the present rope bears up against the bending test much more than a fiber rope in which all of the fibers composing the rope are integrally combined together by the thermosetting resin. Although the reinforcing fibers such as glass fibers or aramid fibers in each strand are twisted to maintain a round cross sectional shape in the strand in the rope and, thereby, the tensile strength of the fiber bundle is somewhat reduced, each fiber itself has high tensile strength and low elongation, whereby compared with the conventional wire rope formed to have substantially the same tensile strength, the present rope is far lighter than the wire rope and will not necessitate vast supporting means or wind-up means of the present rope.

Preferably, in order that the present rope may have high tensile strength while the fibers are twisted, the reinforcing fibers are slightly or softly twisted in such a manner that the tensile strength of the twisted fibers is reduced to no less that 50 percent of that of the fiber bundle which is not twisted.

In a rope used in a dynamic condition with a wind-up drum or the like, not only the tensile strength but also the fatigue due to bending should be considered. The tensile strength of the rope can be enhanced by increasing the number of fibers to be contained in the strand. In case the thickness of the thermoplastic resin cover around the fiber bundle is made constant, the rate of area in which the fibers and the thermosetting resin can be contained are increased by making the diameter of the strand larger. The followings are examples showing the relationships in which the strands have the diameters of 5 mm and 10 mm and the thickness of the thermoplastic resin cover is 0.5 mm:

| Diameter of Strand | Area (rate) of Cover | Area (rate) of fibers and thermosetting resin |
|---|---|---|
| 5 mm | 7.06 $mm^2$(36%) | 12.57 $mm^2$(64%) |
| 10 mm | 14.92 $mm^2$(19%) | 63.62 $mm^2$(81%) |

The above table means that the rope formed from the strands having a larger diameter will have higher tensile strength. On the other hand, when the strands having the larger diameter are used to form the rope having a higher tensile strength, the rope, when curved, will have a larger difference in stresses between the outer curved side and the inner curved side and will cause the larger fatigue in the rope.

As is widely known in obtaining a flexible rope, if the diameter of each strand is made smaller and the number of the strands in the rope is increased, the rate of area in which the reinforcing fibers is contained will be reduced due to the increase of area of the thermoplastic resin cover enclosing the reinforcing fibers. Thus, in a rope of the type as the present invention, it seemed to be contradictory to afford high tensile strength and flexibiliy to the rope. However, in a preferred embodiment of the present invention, in order to afford the high tensile strength and flexibility to the rope, a core fiber bundle integrally connected by urethane resin and covered with thermoplastic resin layer is provided at the center of the other strands in which the reinforcing fibers are applied with polyester resin. In a method for forming a rope according to the present invention, continuously supplied reinforcing fibers having the high tensile strength and low elongation are twisted in such a manner that the tensile strength of the twisted fibers is reduced to no less than 50 percent of that of the fibers which are not twisted. The twisted fibers are applied with uncured thermosetting resin and then covered with a molten thermoplastic resin, which is cooled to form a strand in which the fibers applied with the uncured thermosetting resin is coated with a thin solidified thermoplastic resin. A plurality of these strands is formed into a rope structure and is subjected to heat treatment to cure the thermosetting resin in each strand.

In the method of the present invention, each strand is flexible since the termosetting resin therein is still uncured, so that it is very easy to form a rope structure from the plural strands. In the rope forming step each strand keeps a round sectional shape since the fibers therein are twisted. Further, the fibers are covered with the solidified thermoplastic resin layer, so that the fibers cannot be separated or cut off during the rope forming step of the strands.

The aforementioned and other objects and features of the present invention shall be described hereinafter in detail with reference to preferred embodiments thereof shown in the accompanying drawings, in which:

DESCRIPTION OF THE DRAWINGS

FIGS. 1–3 are views showing a method for forming a rope according to the present invention, wherein FIG. 1 is a schematic side view showing the step of forming a fiber bundle applied with an uncured thermosetting resin, FIG. 2 is a schematic side view showing the step of forming a strand, FIG. 3 is a schematic side view showing the step of forming a rope according to the present invention.

DETAILED DESCRIPTION OF THE INVENTION

Figure 1:
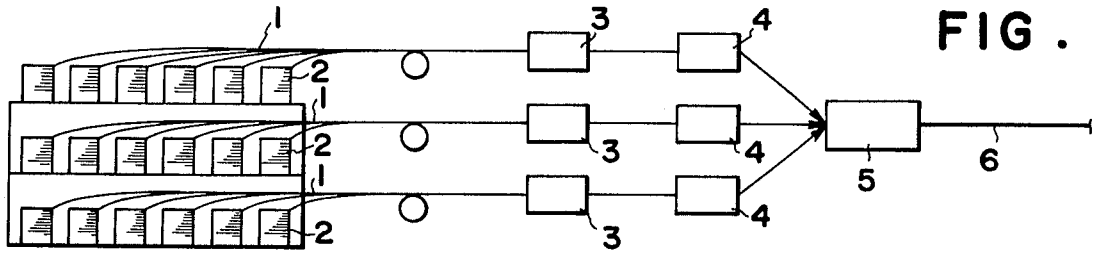
Figure 2:
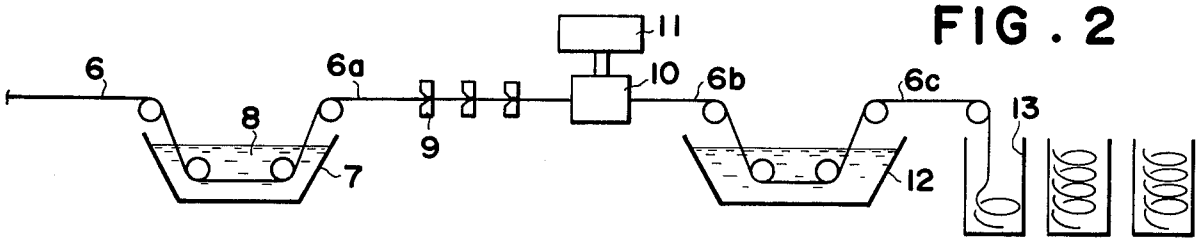
Figure 3:
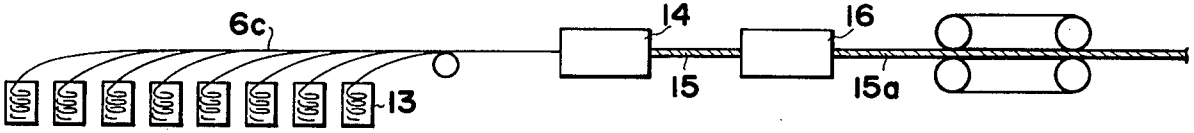

Referring first to FIGS. 1 to 3 showing the present method for forming a rope, six reinforcing fibers 1 having high tensile strength and low elongation, such as glass fibers or aramid fibers (for example, "KEVLAR" T29 by DuPont), are drawn out of packages 2 and are twisted through a twister 3 at a rate of four twists per 30 cm, thereby forming a yarn 4 from the six fibers 1. Thus, fifteen yarns are formed and these yarns 4 are twisted through another twister 5 to form a fiber bundle 6 having a lead of 50 mm and a diameter of 5 mm.

The fiber bundle 6 thus formed by the steps in FIG. 1 is then treated by the steps shown in FIG. 2. The fiber bundle 6 is led into a resin apply chamber 7, wherein 3 percent of benzoyl peroxide is added to the uncured thermosetting resin at the rate of 7 g per 1 m of the fiber bundle. The fiber bundle **6*a* coated with the thermosetting resin is then led into a series of shaping dies 9 each having a circular hole in section. After passing through the shaping dies 9, the fiber bundle is shaped to have a desired diameter. This shaped bundle is then led into an extrusion die 10, which has a central passage through which the fiber bundle is allowed to pass linearly while maintaining the given shape. The extrusion die 10 is communicated with an extruder 11 from which molten polyethylene at the temperature of about 200° C is annularly and radially extruded around the periphery of the fiber bundle coming out of the outlet of the central passage in the extrusion die 10. To insure close contact between the molten thermoplastic resin and the fiber bundle, a vacuum is applied between the inside of the annulary extruded thermoplastic resin and the periphery of the fiber bundle. In this embodiment, the thermoplastic resin is extruded to form a resin cover of 0.5 mm around the fiber bundle. The covered fiber bundle 6*b* is immediately led into a cooling bath 12 to solidify the molten thermoplastic resin cover, thereby forming a flexible strand 6*c* in which the thermosetting resin in the strand is still uncured. The strand is cut to desired length and stored in storage chambers 13**.

Eight strands **6*c* each contained in the storage chamber 13 are taken out of the storage chambers, as shown in FIG. 3, and plaited in a known manner in to a rope 15 through a plaiting machine 14. The plaited rope 15 is then led into a hot water bath 16 heated to a temperature of about 100° C and the unsaturated polyester resin in the strand 6*c* is cured completely therethrough, thereby providing a rope 15*a*** according to the present invention.

Figure 4:
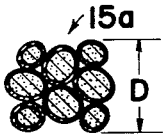
FIGS. 4 and 5 are a cross sectional view and a side view, respectively, showing the rope according to a first embodiment of the present invention.
Figure 5:
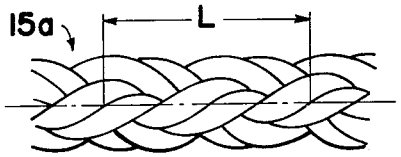

The rope **15*a* thus formed has, as shown in FIGS. 4 and 5**, the diameter (D) of 22 mm and the rope lead (L) of 133 mm. The following table shows comparison data between the present rope and the wire rope of substantially the same diameter.

| | Present Rope | Wire Rope (JIS. No. 4) |
|---|---|---|
| Diameter (mm) | 22 | 22 |
| Unit Weight (kg/m) | 0.314 | 1.610 |
| Tensile Strength (ton) | 15–15.5 | 22.5 |
| Elongation at Breaking Point (%) | 4.5 | 5 |

It could be noted from the above table that the tensile strength of the present rope is somewhat lower than that of the wire rope, but that the weight of the present rope is far lighter than that of the wire rope. Therefore, when the present rope is formed to have substantially the same tensile strength as the wire rope, the present rope can still be far lighter than the wire rope.

The following table shows the relation between the tensile strength and the elongation of the present rope, in which the rope leads (L) and the diameter (D) of the rope were changed.

| Sample No. | Rope Lead (mm) | Diameter (mm) | Tensile Strength (kg) | Elongation (%) |
|---|---|---|---|---|
| 1 | 40 | 4.9 | 1.950 | 5.5 |
| 2 | 50 | 4.9 | 1.980 | 5.5 |
| 3 | 60 | 4.8 | 2.020 | 5.0 |
| 4 | 70 | 4.7 | 2.150 | 4.5 |

*Reinforcing fiber: Aramide fiber (KEVLAR 1500 Denier type 29)
Rope structure : 6×15, 135000 denier
Tensile Strength of each fiber: 22g/denier in average When the length of the rope lead was made eight to 15 times as large as the diameter of the rope, the rate of increase of elongation of the rope could be about 2 percent of fiber bundles not twined. Further, compared with the maximum tensile strength of 2970 kg (22 g/de × 135,000) of the non-twined fiber bundles, the present rope could have the tensile strength of more than 60 percent of the maximum tensile strength of the non-twined fiber bundles.

The sectional shape of the formed rope had a larger diameter of 7 mm, a smaller diameter of 5.5 mm and an average diameter of 6.5 mm and could have a substantially round configuration as desired.

The rope of the present invention was subjected to a bending test and compared with another type of rope which is similar to the present rope except that the reinforcing fibers of the same kind as the present rope are bundled together without twisting to form the strand. The following is a test data obtained by subjecting the both ropes to a rope binding test machine under a load of 1 ton until the ropes are broken.

The present rope: 18,667 times

Another similar rope: 7,130 times

As can be known from the above test data, the present rope in which the reinforcing fibers in the strand are twisted has a remarkable advantage against the fatigue due to bending. This means that since each strand in the present rope maintains a substantially round sectional shape due to the twisted fibers therein and the fiber bundle in each strands is isolated from other fiber bundles in the other strand by means of thermoplastic resin covers, when the rope is bent, the strands slightly slide from each other and partially absorb bending stress therein. On the other hand, in the other similar rope structure in the above table, each strand cannot maintain its circular sectional shape and comes to have a substantially flat sectional shape in the formed rope and is firmly engaged with other adjacent strands. Therefore, when the rope is bent, the bending stress is fully applied in the radial directionn of the rope at a place where the rope is bent.

In order to afford higher flexibility and smaller fatigue by bending, it is preferred to use only enough thermosetting resin to stabilize the configuration of the rope when the thermosetting resin is cured in the final rope-forming step. Such a small amount of thermosetting resin reduces the rigidly of the rope, but does not substantially reduce the tensile strength thereof. More preferably, aramid fibers provided with polyurethane lining are used and the amount of the thermosetting resin is minimized.

Figure 6:
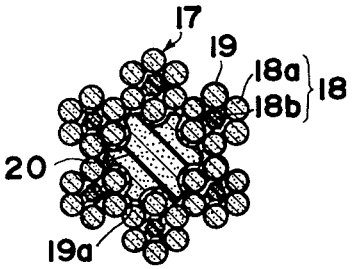
FIGS. 6 and 7 are a cross sectional view and a side view, respectively, showing the rope according to a second embodiment of the present invention.
Figure 7:
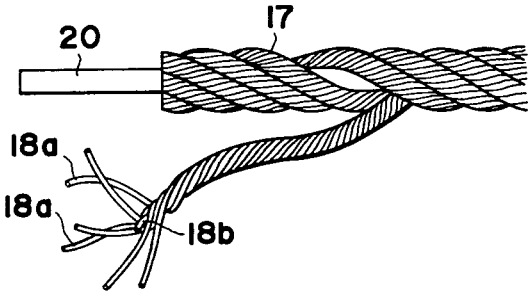

Reference is now made to another embodiment of the present invention shown in FIGS. 6 and 7, in which the rope is made to have higher flexibility. In this embodiment, six strands 17 are positioned round the periphery of a core fiber bundle 20. Each strand 17 comprises six outer fiber bundle 18*a* around an inner fiber bunlde 18*b*. In the outer fiber bundle 18*a*, 90 aramid fibers of 1500 denier are slightly twisted, impregnated with uncured thermosetting polyester resin, and covered with a thermoplastic nylon layer of 0.5 mm thick. The diameter of the outer fiber bundle 18*a* is 6.5 mm.

The inner fiber bundle 18*b* enclosed inside of the outer fiber bundles 18*a* is formed by impregnating 90 aramid fibers of 1500 denier with uncured thermosetting polyurethane resin which has been prepared to have the hardness of about 60, when cured, and by covering the thus resin-impregnated fibers with a nylon layer 0.5 mm thick. The diameter of the inner fiber bundle 18*b* was also 6.5 mm.

Each strand 17 was formed by laying the outer fiber bundle 18*a* around the inner fiber bundle 18*b* in a known manner.

In the present rope according to this embodiment, these six strands 17 are laid around the core fiber bundle 20 which is formed by impregnating aramid fibers with uncured thermosetting polyurethane resin and covering the resin impregnated aramid fibers with nylon 19*a*. It should be noted here that when the outer six strnads 17 are placed around the core fiber bundle 20, the thermosetting polyester resin and polyurethane resin in the strands 17 and the core fiber bundle 20 are uncured, respectively, so that the laying process can be carried out easily. After the positioning, these strands 17 and the core fiber bundle 20 are led into a heated chamber or hot water bath to cure the thermosetting resin in the strands and the core fiber bundle, thereby stabilizing the rope configuration.

In the second embodiment set forth above, each strand 17 comprises six outer fiber bundles 18*a* impregnated with thermosetting polyester resin and one inner fiber bundle 18*b* impregnated with thermosetting polyurethane resin. However, the inner fiber bundle 18*b* may be formed like the outer fiber bundle 18*a*, i.e. the reinforcing fibers for forming the inner fiber bundle may be impregnated with the thermosetting polyester resin. Alternatively, each strand may be made of one fiber bundle like the first embodiment, in which the fiber bundle is slightly twisted, impregnated with uncured thermosetting polyester resin and covered with thermoplastic resin.

In this second embodiment according to the present invention, since the core fiber bundle using thermosetting urethane resin is provided inside of the relatively rigid outer strands, compared with the rope of the first embodiment in which all of the strands contain rigid thermosetting polyester resin, the rope according to the second embodiment is lighter in weight and more flexible due to the lightness and flexibility of the urethane resin and has substantially the same high tensile strength and low elongation. Thus, the rope according to the second embodiment is very useful when used in a dynamic condition with a wind-up drum, winch or such.

Further, when the rope according to the second embodiment is used in a dynamic condition with the wind-up drum or such, if an excess stress is applied thereto suddenly in the radial direction at the position where the rope contacts the drum, the core fiber bundle can be compressed through the outer strands due to the elasticity of the urethane resin and, therefore, can partially absorb the stress with the result that the injury and damages of the rope are reduced.

Although it is known in the wire rope to provide a fiber bundle as a core member inside of the wire strands, such a fiber bundle is provided only for holding oil to prevent rusting of the outer wire strand and to reduce friction between the wires comprising the wire rope. Thus, the fiber bundle in the wire rope does not contribute to the tensile strength of the wire rope in substance. On the other hand, according to the present rope in the second embodiment, while the thermosetting urethane resin in the core fiber bundle 20 is uncured, the outer strands 17 is laid, braided or plaited around the core fiber bundle 20 in which the reinforcing fibers are combined with the urethane resin, so that the urethane resin extends to the spaces between the outer strands 20 and the core fiber bundle 20 also contributes to the tensile strength of the rope together with the outer strands.

Although the present invention has been described with reference to preferred embodiments, many modifications and alterations may be made within the spirit of the present invention. For example, in the method for formming the rope, the uncured thermosetting resin may be applied to the reinforcing fibers before these yarns are twisted or while these yarns are twisted. Further, to form a rope structure in the present invention, the strands may be laid, braided or plaited.

What we claim is:

1. A rope comprising:

an inner core fiber bundle comprised of:

a plurality of first synthetic fibers, a first thermosetting resin impregnating and connecting said first fibers, and a first thermoplastic coating layer surrounding said first thermosetting resin immpregnated fibers; and a plurality of outer fiber bundles surrounding said core fiber bundles, each outer fiber bundle comprised of:

a plurality of second synthetic fibers, a second thermosetting resin impregnating said second fibers, and a second thermoplastic resin coating layer surrounding said second fibers impregnated with said thermosetting resin.

2. A rope as claimed in claim 1, wherein:

said first synthetic fibers are aramid fibers and said first thermosetting resin impregnating said first synthetic fibers is an uncured thermosetting polyurethane resin;

said second synthetic fibers are slightly twisted aramid fibers, and said second thermosetting resin impregnating said second synthetic fibers is an uncured thermosetting polyurethane resin; and said first and second thermoplastic resin coverings are thermoplastic nylon.

3. The rope comprising:

a first core fiber bundle comprised of:

a plurality of first synthetic fibers, a first thermosetting resin impregnating said first fibers, and a first thermoplastic resin layer covering said impregnated fibers; and a plurality of strands surrounding said first core fiber bundle, each strand comprised of:

a second inner core fiber bundle comprised of:

a plurality of second synthetic fibers, a second thermosetting resin impregnating and connecting said second fibers, and a second thermoplastic coating layer surrounding said second thermosetting resin impregnated fibers, a plurality of outer fiber bundles surrounding said second core fiber bundle, each outer fiber bundle comprised of:

a plurality of third synthetic fibers, a third thermosetting resin impregnating said third fibers; and a third thermoplastic resin covering surrounding said third thermosetting resin impregnated fibers.

4. A rope as claimed in claim 3 wherein:

said first, second and third synthetic fibers are aramid fibers;

said first and second thermosetting resins are uncured thermosetting polyurethane resin;

said third thermosetting resin impregnating said third synthetic fibers is an uncured thermosetting polyester resin; and said first, second and third thermoplastic resin coverings are thermoplastic nylon.

5. A rope as claimed in claim 3 wherein:

said first, second and third synthetic fibers are aramid fibers;

said first thermosetting resin is an uncured thermosetting polyurethane resin;

said second and third thermosetting resins are uncured thermosetting polyester resin; and said first, second and third thermoplastic resin coverings are thermoplastic nylon.

* * * * *

UNITED STATES PATENT AND TRADEMARK OFFICE

CERTIFICATE OF CORRECTION

PATENT NO. : 4,050,230

DATED : September 27, 1977

INVENTOR(S) : Tadao Senoo and Kenji Honda

It is certified that error appears in the above-identified patent and that said Letters Patent are hereby corrected as shown below:

In the heading No. [73] change the name of the Assignee from "Toyo Rope Manufacturing Co., Ltd.," to --Tokyo Rope Manufacturing Co., Ltd.--

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*